US010945533B1

(12) United States Patent
Shi

(10) Patent No.: US 10,945,533 B1
(45) Date of Patent: Mar. 16, 2021

(54) AIR BED

(71) Applicant: DONGGUAN HONGYU PLASTIC CO., LTD, Dongguan (CN)

(72) Inventor: Juying Shi, Dongguan (CN)

(73) Assignee: DONGGUAN HONGYU PLASTIC CO., LTD, Dongguan (CN)

( * ) Notice: Subject to any disclaimer, the term of this patent is extended or adjusted under 35 U.S.C. 154(b) by 0 days.

(21) Appl. No.: 16/900,946

(22) Filed: Jun. 14, 2020

(51) Int. Cl.
*A47C 27/08* (2006.01)

(52) U.S. Cl.
CPC ..... *A47C 27/081* (2013.01); *A47C 27/087* (2013.01)

(58) Field of Classification Search
CPC ..... A47C 27/08; A47C 27/081; A47C 27/087; A47C 23/047
See application file for complete search history.

(56) References Cited

U.S. PATENT DOCUMENTS 3,251,075 A * 5/1966 Saltness ..... A47C 27/18 5/644
6,185,770 B1 * 2/2001 Wang ..... A47C 27/081 5/686
7,089,618 B1 * 8/2006 Metzger ..... A47C 27/081 5/709
2004/0074004 A1 * 4/2004 Boso ..... A47C 27/082 5/710
2005/0223495 A1 * 10/2005 Wu ..... A47C 27/087 5/711
2006/0265810 A1 * 11/2006 Wu ..... A47C 27/081 5/712
2007/0283499 A1 * 12/2007 Lin ..... A47C 27/081 5/712
2011/0191961 A1 * 8/2011 Wu ..... A47C 27/087 5/711
2012/0000017 A1 * 1/2012 Xia ..... A47C 27/081 5/706
2017/0196368 A1 * 7/2017 Liu ..... A47C 27/081

* cited by examiner

*Primary Examiner* — Peter M. Cuomo
*Assistant Examiner* — Ifeolu A Adeboyejo
(74) *Attorney, Agent, or Firm* — Maschoff Brennan

(57) ABSTRACT

An air bed is provided, including: an upper sheet, a lower sheet, a left side sheet, a right side sheet, a first structural pull belt and a second structural pull belt, wherein the upper sheet, the lower sheet, the left side sheet and the right side sheet define one air chamber. The upper sheet and the lower sheet are connected with each other at the front and the back, and an inner edge of a joint between the upper sheet and the lower sheet is provided with the first structural pull belt. The left side sheet is connected with the upper sheet and the lower sheet to form a left side wall of the air bed, and an inner edge of a left joint is provided with the second structural pull belt.

18 Claims, 2 Drawing Sheets

AIR BED

CROSS-REFERENCE TO RELATED APPLICATION

The present disclosure claims priority of the Chinese Patent Application with the filing number 202020328338.0, filed on Mar. 16, 2020 with the Chinese Patent Office, and entitled "Air Bed", the contents of which are incorporated herein by reference in their entirety.

TECHNICAL FIELD

The present disclosure relates to the technical field of inflatable products, in particular to an air bed (inflatable bed).

BACKGROUND ART

The air bed is a common product for daily life and travel at present, and common air beds currently available on the market are not stable enough when being supported, and are prone to a large deformation, thereby influencing the use experience of users.

Optionally, the air bed is divided into a plurality of air chambers in order to improve the supporting capability, but in doing so, there is a problem that the processing difficulty becomes higher, the cost is also increased, while the production efficiency is reduced.

SUMMARY

Embodiments of the present disclosure are realized as follows:

An embodiment of the present disclosure provides an air bed, including: an upper sheet, a lower sheet, a left side sheet, a right side sheet, first structural pull belts and second structural pull belts, wherein the upper sheet, the lower sheet, the left side sheet and the right side sheet define one air chamber;

the upper sheet and the lower sheet are connected with each other at the front and the back, to form a front side wall of the air bed at a front end, and a rear side wall of the air bed at a rear end, and each inner edge at a respective joint between the upper sheet and the lower sheet is provided with the first structural pull belt;

the left side sheet is connected with the upper sheet and the lower sheet to form a left side wall of the air bed, and an inner edge at a left joint is provided with the second structural pull belt; and the right side sheet is connected with the upper sheet and the lower sheet to form a right side wall of the air bed, and an inner edge at a right joint is provided with the second structural pull belt.

BRIEF DESCRIPTION OF DRAWINGS

In order to more clearly illustrate technical solutions of embodiments of the present disclosure, accompanying drawings which need to be used in the embodiments will be introduced below briefly, and it should be understood that the accompanying drawings below merely show some embodiments of the present disclosure, and therefore should not be considered as limitation on the scope, and a person ordinarily skilled in the art still could obtain other relevant accompanying drawings according to these accompanying drawings, without any creative effort.

Figure 1:
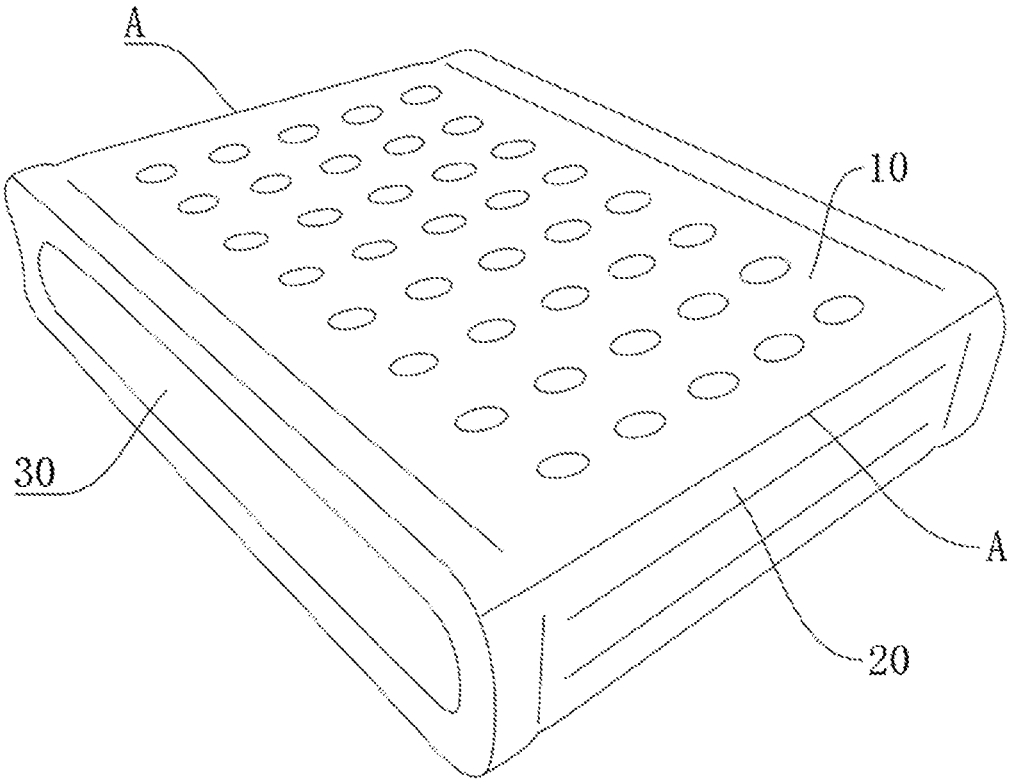
FIG. 1 is a schematic view of an air bed provided in an embodiment of the present disclosure.

Reference signs: 10—upper sheet; 20—lower sheet; 30—left side sheet; 40—right side sheet; 50—first structural pull belt; 60—second structural pull belt; 70—connection body; 80—shaping limit pull belt; 90—air chamber.

DETAILED DESCRIPTION OF EMBODIMENTS

In order to make objects, technical solutions and advantages of the embodiments of the present disclosure clearer, the technical solutions in the embodiments of the present disclosure will be described clearly and completely below in conjunction with the accompanying drawings in the embodiments of the present disclosure, and apparently, some but not all embodiments of the present disclosure are described. Generally, components in the embodiments of the present disclosure described and shown in the accompanying drawings herein can be arranged and designed in different configurations.

Therefore, the detailed description below of the embodiments of the present disclosure provided by the accompanying drawings is not intended to limit the scope of protection of the present disclosure, but merely represents selected embodiments of the present disclosure. All other embodiments obtained by those ordinarily skilled in the art based on the embodiments of the present disclosure without any creative effort shall fall within the scope of protection of the present disclosure.

It should be noted that similar reference signs and letters represent similar items in the following accompanying drawings, and therefore once a certain item is defined in one accompanying drawing, it is not needed to be further defined or explained in subsequent accompanying drawings.

In the description of the present disclosure, it should be indicated that orientational or positional relations indicated by terms such as "upper", "lower", "left", "right", "front" and "back" are based on orientational or positional relations as shown in the accompanying drawings, or orientational or positional relations of a product when being conventionally placed in use, merely for facilitating describing the present disclosure and simplifying the description, rather than indicating or implying that related devices or elements have to be in the specific orientation or configured and operated in a specific orientation, therefore, they should not be construed as limitations on the present disclosure. Besides, terms such as "first" and "second" are merely used for distinctive description, but should not be construed as indicating or implying importance in the relativity.

In the description of the present disclosure, it further should be indicated that unless otherwise specified and defined explicitly, terms "provide" and "connect" should be construed in a broad sense. For example, a connection may be fixed connection, detachable connection, or integral connection; it may be mechanical connection, and may also be electrical connection; it may be direct connection, indirect connection through an intermediary, or inner communication between two elements. For a person ordinarily skilled in the art, specific meanings of the above-mentioned terms in the present disclosure could be understood according to specific circumstances.

An object of the present disclosure is to provide an air bed, which can solve the problems of existing air beds.

An embodiment of the present disclosure is realized as follows:

An embodiment of the present disclosure provides an air bed, including: an upper sheet 10, a lower sheet 20, a left side sheet 30, a right side sheet 40, a first structural pull belt 50 and a second structural pull belt 60, wherein the upper sheet 10, the lower sheet 20, the left side sheet 30 and the right side sheet 40 define one air chamber 90;

the upper sheet 10 and the lower sheet 20 are connected with each other at the front and the back of the air bed, to form a front side wall of the air bed at a front end, and a rear side wall of the air bed at a rear end, wherein an inner edge at a joint between the upper sheet 10 and the lower sheet 20 is provided with the first structural pull belt 50;

the left side sheet 30 is connected with the upper sheet 10 and the lower sheet 20 to form a left side wall of the air bed, wherein an inner edge at a left joint is provided with the second structural pull belt 60; and the right side sheet 40 is connected with the upper sheet 10 and the lower sheet 20 to form a right side wall of the air bed, wherein an inner edge at a right joint is provided with the second structural pull belt 60.

Optionally, an upper edge and a lower edge inside the left joint are each provided with the second structural pull belt 60.

Optionally, an upper edge and a lower edge inside the right joint are each provided with the second structural pull belt 60.

Optionally, the air bed includes connection bodies 70, the left side sheet 30 and the right side sheet 40 are each provided with the respective connection body 70, wherein a lower edge of the second structural pull belt 60 connected with the upper sheet 10 is connected with an upper edge of the respective connection body 70, and an upper edge of the second structural pull belt 60 connected with the lower sheet 20 is connected with a lower edge of the respective connection body 70.

Optionally, each of the connection bodies 70 is attached and fixed to the left side sheet 30 or the right side sheet 40.

Optionally, the second structural pull belts 60 located on the same side which are up and down distributed are integrally molded with the respective connection body 70.

Optionally, each connection body 70 is provided with a plurality of annular openings arranged at intervals, and a support rib is arranged between adjacent annular openings.

Optionally, each connection body 70 is formed in an "I" shape, and two long strips of the connection body 70 are respectively connected with the two second structural pull belts 60 on the same side.

Optionally, each connection body 70 includes a plurality of short strips located between the two long strips, wherein the plurality of short strips are arranged at intervals in an extending direction of the long strips.

Optionally, an upper edge and a lower edge inside the front of the air bed are each provided with the first structural pull belt 50.

Optionally, an upper edge and a lower edge inside the back of the air bed are each provided with the first structural pull belt 50.

Optionally, an included angle is formed between the respective first structural pull belt 50 and the upper sheet 10.

Optionally, an included angle is formed between the respective first structural pull belt 50 and the lower sheet 20.

Optionally, the air bed further includes a shaping limit pull belt 80, wherein the shaping limit pull belt 80 is connected between the upper sheet 10 and the lower sheet 20 and located inside the air chamber 90.

Optionally, the shaping limit pull belt 80 is in an annular structure.

Optionally, the shaping limit pull belt 80 includes two opposite connecting walls, wherein the two connecting walls are attached and fixed to the upper sheet 10 and the lower sheet 20, respectively.

Optionally, a plurality of shaping limit pull belts 80 are provided arranged in an array inside the air chamber 90.

Optionally, each shaping limit pull belt 80 is connected with the upper sheet 10 by bonding or sewing.

Optionally, each shaping limit pull belt 80 is connected with the lower sheet 20 by bonding or sewing.

Beneficial effects brought by the present disclosure include, for example:

The front side wall and the rear side wall of the air bed are formed by the upper sheet 10 and the lower sheet 20, then an amount of crimping of the front side wall and the rear side wall is reduced, and the structure is simplified. In combination with the arrangement of one air chamber 90, the overall manufacture process can be further simplified. In combination with the effects of the first structural pull belts 50 and the second structural pull belts 60, the supporting performance also can be ensured, and the shaping of the air bed also can be realized under the condition of simplifying the process.

Figure 2:
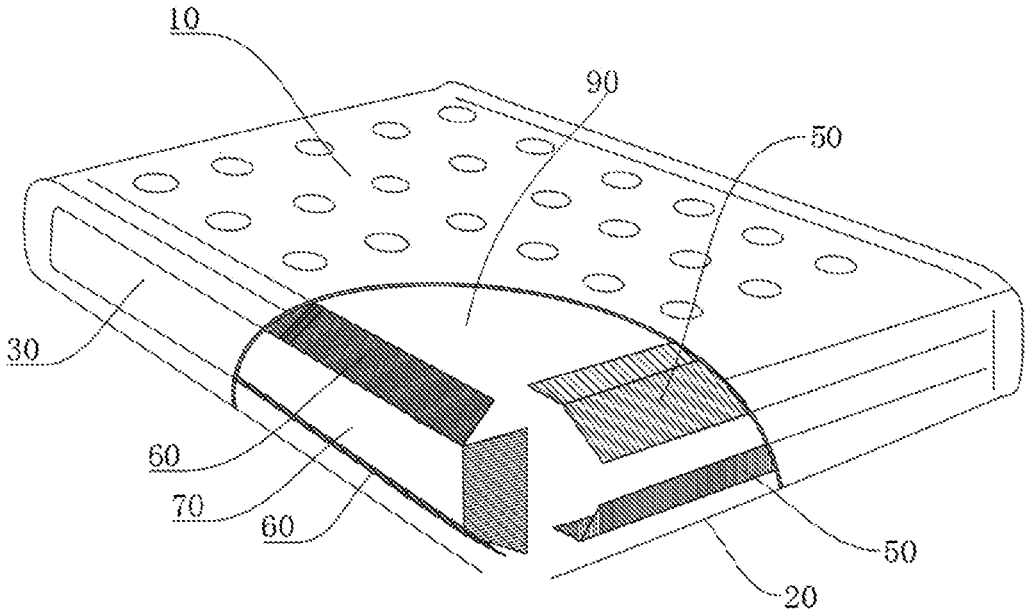
FIG. 2 is a partial sectional view of FIG. 1.
Figure 3:
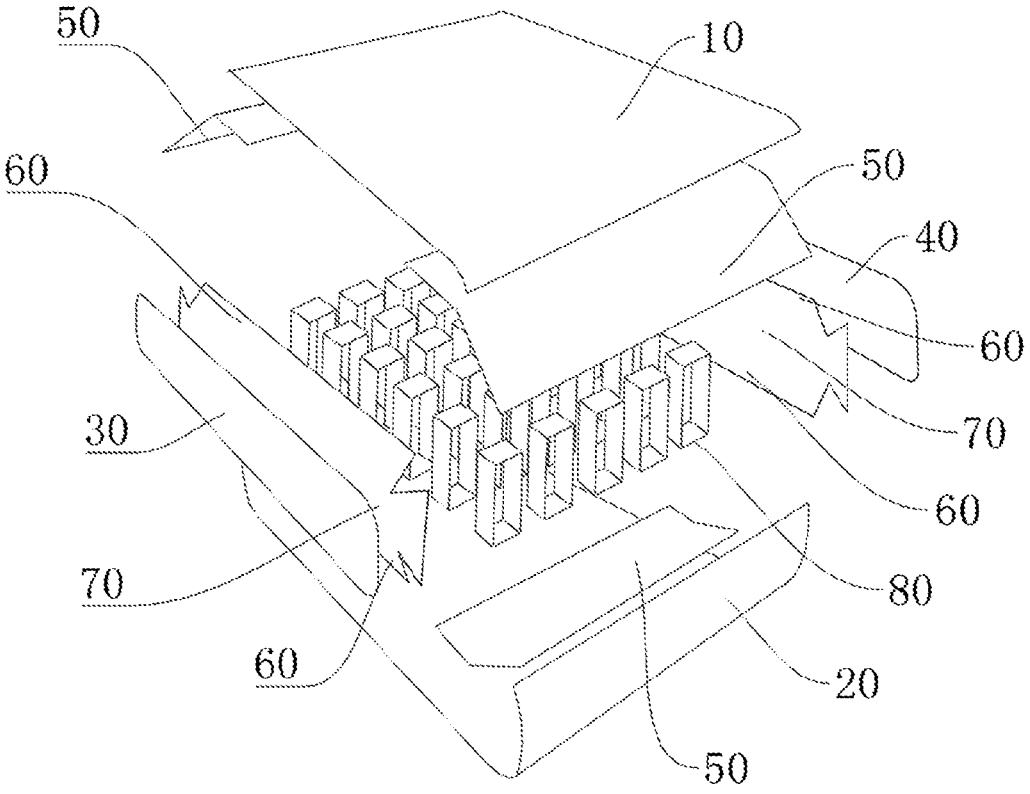
FIG. 3 is an exploded view of FIG. 1.

Referring to FIG. 1 to FIG. 3, the present disclosure provides an air bed, including: an upper sheet 10, a lower sheet 20, a left side sheet 30, a right side sheet 40, first structural pull belts 50 and second structural pull belts 60, wherein the upper sheet 10, the lower sheet 20, the left side sheet 30 and the right side sheet 40 define one air chamber 90.

The upper sheet 10 and the lower sheet 20 are connected with each other in the front and in the back, that is to say, a front end of the upper sheet 10 is connected with a front end of the lower sheet 20, a rear end of the upper sheet 10 is connected with a rear end of the lower sheet 20, so as to form a front side wall of the air bed at a front end, and form a rear side wall of the air bed at a rear end, and each inner edge at corresponding joint between the upper sheet 10 and the lower sheet 20 is provided with the first structural pull belt 50.

Both upper side and lower side of the left side sheet 30 are connected with the upper sheet 10 and the lower sheet 20, respectively, to form a left side wall of the air bed, wherein an inner edge at a joint between the left side sheet 30 and the upper sheet 10 is provided with the second structural pull belt 60, and an inner edge at a joint between the left side sheet 30 and the lower sheet 20 is provided with the second structural pull belt 60.

Both upper side and lower side of the right side sheet 40 are connected with the upper sheet 10 and the lower sheet 20, respectively, to form a right side wall of the air bed, wherein an inner edge at a joint between the right side sheet 40 and the upper sheet 10 is provided with the second structural pull belt 60, and an inner edge at a joint between the right side sheet 40 and the lower sheet 20 is provided with the second structural pull belt 60.

In the present disclosure, as the front side wall and the rear side wall are formed by connecting the upper sheet 10 and the lower sheet 20, no side wall is required to be additionally provided to construct the front side wall and the rear side wall, so that procedures for processing the front side wall and the rear side wall are effectively saved, and the production cost is reduced, moreover, the first structural pull belts 50 can effectively ensure the supporting capability of the air bed, and after inflation, the whole air bed can be normally shaped, and the supporting capability during use can be maintained. Meanwhile, such structure allows that normal supporting performance can still be ensured and normal use in daily life or travel can be met, with only one air chamber 90 provided. Unlike common air beds in which a plurality of air chambers 90 are required to be provided, the amount of crimping and the material loss during production and processing are reduced, then the processes are further simplified and the cost is reduced compared with common air beds.

In the present disclosure, the inner edges of the left joints between the left side sheet 30 and the upper sheet 10 and the lower sheet 20 are each provided with the second structural pull belt 60. The inner edges of the right joints between the right side sheet 40 and the upper sheet 10 and the lower sheet 20 are each provided with the second structural pull belt 60. The upper and lower structural pull belts 60 at the left joints can shape the left side of the air bed, and ensure normal supporting strength of the air bed, thus preventing overturning or relatively large deformation of a bed body when a user presses the left portion of the air bed, such that the user has better use experience. Likewise, the upper and lower structural pull belts 60 at the right joints can shape the right side of the air bed, and ensure normal supporting strength of the air bed, thus preventing overturning or relatively large deformation of a bed body when a user presses the right portion of the air bed, such that the user has better use experience.

In the present disclosure, the second structural pull belts 60, independent from each other, are configured to connect the upper sheet 10 with the left side sheet 30 and the right side sheet 40, and to connect the lower sheet 20 with the left side sheet 30 and the right side sheet 40, respectively.

Optionally, the air bed further includes a connection bodies 70, wherein one of the connection bodies 70 is fixedly connected with the left side sheet 30, a lower edge of the second structural pull belt 60 connected with the upper sheet 10 is connected with an upper edge of the connection body 70, and an upper edge of the second structural pull belt 60 connected with the lower sheet 20 is connected with a lower edge of the connection body 70. For the right side sheet 40, another connection body 70 also can be provided similarly in the above manner. The connection bodies 70 not only can increase the supporting strength of the whole left side wall and the whole right side wall, but also is conducive to connecting the corresponding upper and lower second structural pull belts 60 with each other, thereby bringing about the beneficial effects of ensuring the shape stability and the supporting stability of both left and right sides of the air bed.

Optionally, each connection body 70 in the present disclosure is a sheet, and is directly attached to an inner side of the left side sheet 30 or an inner side of the right side sheet 40. In this way, the connection between the connection bodies 70 and the left side sheet 30 or the right side sheet 40 can be more stable and more reliable, meanwhile, the connection body 70 made of sheet can also have a larger connection area with the respective second structural pull belts 60, so that the pulling effect of the second structural pull belts 60 is more reliable, which is conducive to maintaining a stable state of the left and right side walls of the air bed after inflation. Optionally, a plurality of annular openings further can be sequentially formed and at intervals in the middle of the connection body 70, and a support rib is arranged between adjacent annular openings, thus, not only the usage amount of the sheet can be reduced to a certain extent, and the cost is saved, but also the structural strength of the connection body 70 will not be reduced, and the structural strength of the connection body 70 is still guaranteed. Evidently, it can also feasible that each connection body 70 is designed into an "I"-shaped sheet, wherein upper and lower long strips of the I-shaped sheet are connected with the upper and lower second structural pull belts 60 located on the same side, respectively, one or more vertical short strips may be located between the upper and lower long strips, and when a plurality of vertical short strips are provided, the plurality of vertical short strips are arranged side by side in an extending direction of the long strips, so that the usage amount of the sheet also can be reduced to a certain extent, and the structural strength of the connection body 70 is still guaranteed. In addition, the connection body 70 also can be formed by stacking composite sheets, for example, it may be a combination of three layers of sheets with different sizes, for example, smaller sheets at two sides and a larger sheet in the middle, or a combination of different materials, and the connection body formed 70 is attached to the inner wall of the left side sheet 30 or the inner wall of the right side sheet 40.

Referring to FIG. 3, optionally, the second structural pull belts 60 located on the same side which are up and down distributed are directly manufactured integrally with the respective connection body 70, which saves the procedure of independently processing the connection body 70 and the structural pull belts 60 and then connecting them, not only the connection reliability can be ensured, but also the processing time can be saved, and the time cost also can be reduced while improving the manufacturing efficiency.

Optionally, an upper edge and a lower edge inside the front of the air bed are each provided with the respective first structural pull belt 50. An upper edge and a lower edge inside the back of the air bed are each provided with the respective first structural pull belt 50. The arrangement of the first structural pull belts 50 on both the upper edge and the lower edge of the front end assists in shaping the front end portion of the air bed, and the air bed can maintain good supporting strength during use, and the use experience is improved. Likewise, the arrangement of the first structural pull belts 50 on both the upper edge and the lower edge of the rear end assists in shaping the rear end portion of the air bed, and the air bed can maintain good supporting strength during use, and the use experience is improved It should be noted that the number of the first structural pull belts 50 located on the same side and the second structural pull belts 60 located on the same side may each be set as required, for example, in the present disclosure, the front ends of the upper sheet 10 and the lower sheet 20 are connected by two first structural pull belts 50, and the rear ends of the upper sheet 10 and the lower sheet 20 are connected by another two first structural pull belts 50; the upper sheet 10 and the left side sheet 30 are connected by one second structural pull belt 60, and the upper sheet 10 and the right side sheet 40 are connected by another one second structural pull belt 60; and the lower sheet 10 and the left side sheet 30 are connected by one second structural pull belt 60, and the lower sheet 10 and the right side sheet 40 are connected by another one second structural pull belt 60.

In addition, different angles may be selected for the first structural pull belts 50 and the second structural pull belts 60 when they are connected. That is, each first structural pull belt 50 or each second structural pull belt 60 is regarded as a plane, an included angle between this plane and the horizontal plane can be adjusted, in other words, in a normal use state of the air bed, the upper sheet 10 and the lower sheet 20 can be regarded as being in horizontal arrangement, the included angle between each first structural pull belt 50 or each second structural pull belt 60 and the upper sheet 10 or the lower sheet 20 can be adjusted, the respective first structural pull belt 50, the upper sheet 10 and the lower sheet 20 form a triangular structure, which is high in strength and not prone to damage; likewise, the respective second structural pull belt 60, the upper sheet 10 and the lower sheet 20 form a triangular structure, which is high in strength and not easy to damage. Taking one second structural pull belt 60 as an example, an included angle is formed between the second structural pull belt and the upper sheet 10, wherein the included angle may range from 30° to 60°, for example, may be 30°, 35°, 40°, 45°, 50°, 55° or 60° or 31°, 32°, 33°, 34°, 35°, 36°, 42°, 46°, 52° or 56°, as long as strong support for the whole structure can be ensured. In the present disclosure, after the first structural pull belts 50 and the second structural pull belts 60 are connected respectively, their respective angles are set to be 45°, so that each edge position is ensured to be structurally reliable, and good supporting effect after inflation can be provided.

Optionally, in addition to the design in terms of angle, connection areas between the structural pull belts and the upper sheet 10, the lower sheet 20, the left side sheet 30 and the right side sheet 40 can also be adjusted according to the load bearing condition of the product. For example, taking the connection between each first structural pull belt 50 and the upper sheet 10 as an example, it may be the case that the upper edge of the first structural pull belt 50 is connected with the upper sheet 10, or that the upper edge of the first structural pull belt 50 together with a portion near the edge is connected with the upper sheet 10, which increases the contact area therebetween and further enhances the supporting performance. In this way, when the design load capacity of the product is different, there may be more choices, and an amount of the material used which meets the design specification can prevent excessive material usage for the product and waste of the material, such that the support performance of the product is ensured while reducing the cost. Evidently, the lower sheet 20, the left side sheet 30 and the right side sheet 40 may also be connected with the respective first structural pull belts 50 and the respective second structural pull belts 60 in the manner described above.

Referring to FIG. 3, optionally, the air bed in the present disclosure further includes shaping limit pull belts 80, wherein the shaping limit pull belts 80 are connected between the upper sheet 10 and the lower sheet 20 and located inside the air chamber 90. Optionally, a plurality of shaping limit pull belts 80 are arranged in an array inside the air chamber 90. The shaping limit pull belts 80 can prevent the upper sheet 10 and the lower sheet 20 from swelling too much after inflation, and prevent a central portion of the air bed from being excessively bulged, which brings inconvenience for use. By arranging the shaping limit pull belts 80 in an array, the overall flatness of the air bed after inflation can be ensured, and the user will be more comfortable when lying on the air bed.

Each shaping limit pull belts 80 in the present disclosure may be an annular pull belt, that is, the shaping limit pull belt 80 is in an annular structure, in this way, the connection area between the shaping limit pull belts 80 and the upper sheet 10 and the lower sheet 20 can be increased, and after inflation, a pulling force between the upper sheet 10 and the lower sheet 20 is distributed more uniformly, avoiding the upper sheet 10 and the lower sheet 20 from being damaged due to pulling.

Optionally, each shaping limit pull belt 80 is a rectangular ring, wherein the shaping limit pull belt 80 includes two opposite rectangular connecting walls, the two connecting walls are each in a planar structure, and the two connecting walls are attached and fixed to the upper sheet 10 and the lower sheet 20, respectively, then the contact area is large, and the connection structure is solid and reliable, and is not easily broken. Apparently, each shaping limit pull belt 80 also can be in an annular structure of other shapes, as long as it includes two oppositely arranged connecting walls, and the fastness of the connection can be improved.

Optionally, each shaping limit pull belt 80 is fixedly connected with the upper sheet 10 by bonding or sewing. Optionally, each shaping limit pull belt 80 is fixedly connected with the lower sheet 20 by bonding or sewing.

The principle of the air bed provided in the present disclosure includes, for example:

In the prior art, common air beds usually have the defect of nonuniform force-bearing which affects use experience, while in cases where a plurality of air chambers 90 are provided to ensure supporting capability, many processing steps are involved, which not only leads to a great waste of time, but also an increased loss of material, and thus increasing the cost.

For example, during the processing and manufacturing, once there appears the situation that a cavity having the air chamber 90 is misplaced during crimping or when one cavity is hot-pressed to another cavity, the another cavity is burnt and damaged, which is likely to cause rework or directly turn the product into a defective product, causing waste. Evidently, the above crimping or hot-pressing is a common manner of connecting various cavities to form a common air bed, and other manners such as bonding also can be used. However, no matter which manner is used, more labor-hours will be consumed during the processing to some extent, then it is not easy to control the time cost, material cost and labor cost, and the producer's load is increased.

For another example, for existing air beds, apart from the plurality of air chambers 90 inside, many joints between upper, lower, left, right, front and rear surface layers also need to be connected together, and all of these will increase the manufacturing process steps of the product, and once the manufacturing is not in place, the supporting capability will be affected; moreover, the use experience after user's purchase of the air bed will be affected.

In view of this, the present disclosure provides an air bed for solving at least one problem of the prior common air beds.

Referring to FIG. 1 and FIG. 3, two A's in FIG. 1 are exactly the joints between the upper sheet 10 and the lower sheet 20 at the front end and the rear end, and in combination with the state when the upper sheet 10 and the lower sheet 20 are separated as shown in FIG. 3, it can be seen that the length of the lower sheet 20 is larger than the length of the upper sheet 10 in the present disclosure, thus the upper sheet 10 and the lower sheet 20 only need to be connected at the two front and rear A's. But in the prior art, both the upper sheet 10 and the lower sheet 20 need to be connected with the side walls, that is, the upper sheet 10 needs to be connected with one side wall at front and back positions respectively, and the same applies to the lower sheet 20, in this way, there are four joints.

It can be understood that the lengths of the upper sheet 10 and the lower sheet 20 can be exchanged, or the lengths of the upper sheet 10 and the length of the lower sheet 20 are equal, that is to say, it is compulsively required that the lower sheet 20 has to be longer than the upper sheet 10. Besides, taking the front side wall as an example, proportions of the upper sheet 10 and the lower sheet 20 forming the front side wall also can have other options, for example, they are in equal proportions, or the upper sheet 10 accounts for 10%, and the lower sheet 20 accounts for 90%; or the upper sheet 10 accounts for 20%, and the lower sheet 20 accounts for 80%; or the upper sheet 10 accounts for 30%, and the lower sheet 20 accounts for 70%; or the upper sheet 10 accounts for 40%, and the lower sheet 20 accounts for 60%. The proportions of the upper sheet and the lower sheet may be different according to needs, as long as the formed connection of the front side wall can be ensured to be reliable, and facilitate use. Likewise, in the formation of the rear side wall, the proportions of the upper sheet 10 and the lower sheet 20 also can be different. Besides, vertical rib structures (not shown in the figures) further can be provided on the front side wall and the rear side wall, thus, the supporting capability of the front and rear side walls can be further enhanced, and it is more convenient to shape the front and rear side walls, so that use comfort will not be reduced by large deformation of the front and rear side walls during use.

Optionally, the left side sheet 30 only needs to be simultaneously connected with the upper sheet 10 and the lower sheet 20, and the right side sheet 40 only needs to be simultaneously connected with the upper sheet 10 and the lower sheet 20, but they do not need to be connected with the side wall. For example, when connecting the left side sheet 30, the left side sheet 30 is an entirety, the upper sheet 10 and the lower sheet 20 become an entirety after they are connected first, then there are fewer joints between the two entireties than between multiple sheets, overall structural strength is enhanced, the connection process is reduced, and the manufacturing efficiency is improved.

Therefore, at joints of corner positions of the air bed, there is no need for higher control accuracy like in processing of common air beds, and reliability of the joints can be ensured and the air bed is not prone to leak under the condition of lower requirements on process. However, in order to avoid air leakage, the common air bed puts higher requirements on the process when connecting multiple sheets, the connection reliability between at least three sheets must be ensured at each corner position, so that the processing speed is slower and it is not easy to simultaneously ensure the processing reliability of these corner positions, thereby reducing the product quality.

While omitting many unnecessary connection steps in the above, the air bed of the present disclosure further can rely on the first structural pull belts 50 and the second structural pull belts 60 at the inner edges to ensure the overall shape thereof, and the air bed after being shaped by inflation still can ensure supporting stability although there is only a single air chamber 90. Thus, many sheets required for forming a plurality of air chambers 90 are further saved, which not only saves the material, but also simplifies the processing technology, such that all of the material cost, the time cost and the labor cost during the manufacturing are better controlled. Combined with the effect of the plurality of shaping limit pull belts 80, the air bed after inflation is enabled to have a more stable state, and sufficient support reliability is provided. In this way, there is not only the effect of uniform force-bearing brought about by a single air chamber 90, but also the effect of auxiliary shaping of the shaping limit pull belts 80, then it is more comfortable to use the air bed.

To sum up, a top wall, a bottom wall, the front side wall and the rear side wall of the air bed are formed by connecting the upper sheet 10 and the lower sheet 20 of the air bed of the present disclosure, then the amount of crimping of the front side wall and the rear side wall is reduced, and the structure is simplified. In combination with the arrangement of one air chamber 90, the overall manufacturing process can be more simplified. In combination with the effects of the first structural pull belts 50 and the second structural pull belts 60, the supporting performance also can be ensured under the condition of simplifying the process, and the shaping of the air bed also can be realized.

The above-mentioned are merely for optional embodiments of the present disclosure and not intended to limit the present disclosure, and for one skilled in the art, various modifications and variations may be made to the present disclosure. Any amendments, equivalent replacements, improvements and so on, within the spirit and principle of the present disclosure, should be covered within the scope of protection of the present disclosure.

INDUSTRIAL APPLICABILITY

To sum up, the present disclosure provides an air bed, which is low in processing difficulty and high in processing efficiency.

What is claimed is:

1. An air bed, comprising: an upper sheet, a lower sheet, a left side sheet, a right side sheet, first structural pull belts and second structural pull belts, wherein the upper sheet, the lower sheet, the left side sheet and the right side sheet define one air chamber;

the upper sheet and the lower sheet are connected with each other at the front and the back of the air bed, to form a front side wall of the air bed at a front end, and a rear side wall of the air bed at a rear end, and each inner edge at a respective joint between the upper sheet and the lower sheet is provided with the respective first structural pull belt;

the left side sheet is connected with the upper sheet and the lower sheet to form a left side wall of the air bed, and an inner edge at a left joint is provided with the respective second structural pull belt; and the right side sheet is connected with the upper sheet and the lower sheet to form a right side wall of the air bed, and an inner edge at a right joint is provided with the respective second structural pull belt, wherein the air bed comprises connection bodies, the left side sheet and the right side sheet are each provided with the respective connection body, a lower edge of the second structural pull belt connected with the upper sheet is connected with an upper edge of the respective connection body, and an upper edge of the second structural pull belt connected with the lower sheet is connected with a lower edge of the respective connection body.

2. The air bed according to claim 1, wherein an upper edge and a lower edge inside the left joint are each provided with the second structural pull belt.

3. The air bed according to claim 1, wherein an upper edge and a lower edge inside the right joint are each provided with the second structural pull belt.

4. The air bed according to claim 1, wherein each connection body is a sheet and each connection body is attached and fixed to the left side sheet or the right side sheet.

5. The air bed according to claim 1, wherein the second structural pull belts located on the same side which are up-down distributed are integrally molded with the respective connection body.

6. The air bed according to claim 1, wherein each connection body is provided with a plurality of annular openings arranged at intervals, and a support rib is arranged between each two adjacent annular openings.

7. The air bed according to claim 1, wherein each connection body is formed in an "I" shape, and two long strips of the connection body are connected with the two second structural pull belts on the same side, respectively.

8. The air bed according to claim 7, wherein each connection body comprises a plurality of short strips located between the two long strips, and the plurality of short strips are arranged at intervals in an extending direction of the long strips.

9. The air bed according to claim 1, wherein an upper edge and a lower edge inside the front of the air bed are each provided with the first structural pull belt.

10. The air bed according to claim 1, wherein an upper edge and a lower edge inside the back of the air bed are each provided with the first structural pull belt.

11. The air bed according to claim 1, wherein an included angle is formed between each first structural pull belt and the upper sheet.

12. The air bed according to claim 1, wherein an included angle is formed between each first structural pull belt and the lower sheet.

13. The air bed according to claim 1, wherein the air bed further comprises a shaping limit pull belt, wherein the shaping limit pull belt is connected between the upper sheet and the lower sheet and located inside the air chamber.

14. The air bed according to claim 12, wherein the shaping limit pull belt is in an annular structure.

15. The air bed according to claim 12, wherein the shaping limit pull belt comprises two opposite connecting walls, wherein the two connecting walls are attached and fixed to the upper sheet and the lower sheet, respectively.

16. The air bed according to claim 12, wherein a plurality of shaping limit pull belts are provided and are arranged in an array inside the air chamber.

17. The air bed according to claim 12, wherein each shaping limit pull belt is connected with the upper sheet by bonding or sewing.

18. The air bed according to claim 12, wherein each shaping limit pull belt is connected with the lower sheet by bonding or sewing.

* * * * *